US008551259B2

(12) United States Patent
Wiedemann

(10) Patent No.: US 8,551,259 B2
(45) Date of Patent: Oct. 8, 2013

(54) INVISIBLE TOILET BOWL DEODORIZER BLOCK

(75) Inventor: Jörn Wiedemann, Holzminden (DE)

(73) Assignee: Symrise AG, Holzminden (DE)

( * ) Notice: Subject to any disclaimer, the term of this patent is extended or adjusted under 35 U.S.C. 154(b) by 1160 days.

(21) Appl. No.: 11/720,685

(22) PCT Filed: Nov. 30, 2005

(86) PCT No.: PCT/EP2005/056357

§ 371 (c)(1),
(2), (4) Date: Jul. 31, 2009

(87) PCT Pub. No.: WO2006/058894

PCT Pub. Date: Jun. 8, 2006

(65) Prior Publication Data

US 2009/0293916 A1 Dec. 3, 2009

(30) Foreign Application Priority Data

Dec. 4, 2004 (DE) ..... 10 2004 058 498

(51) Int. Cl.

| | |
|---|---|
| ***B08B 9/00*** | (2006.01) |
| ***B08B 7/00*** | (2006.01) |
| ***E03D 9/02*** | (2006.01) |
| ***B29B 13/00*** | (2006.01) |
| ***B28B 19/00*** | (2006.01) |

(52) U.S. Cl.
USPC ..... 134/22.1; 134/6; 4/231; 4/232; 264/271.1

(58) Field of Classification Search
USPC ..... 134/22.1, 42, 6; 4/223, 309, 231, 232; 264/271.1, 239
See application file for complete search history.

(56) References Cited

U.S. PATENT DOCUMENTS

| | | | | |
|---|---|---|---|---|
| 2,011,732 | A * | 8/1935 | Saeks | 4/231 |
| 3,545,014 | A * | 12/1970 | Davis | 4/227.1 |
| 3,668,717 | A * | 6/1972 | Curran | 4/231 |
| 3,947,901 | A * | 4/1976 | Willert | 4/231 |
| 4,670,916 | A * | 6/1987 | Bloom | 4/231 |
| 6,854,136 | B2 * | 2/2005 | Leonard et al. | 4/231 |

(Continued)

FOREIGN PATENT DOCUMENTS

| | | |
|---|---|---|
| DE | 19 53 658 | 5/1970 |
| DE | 26 02 514 | 7/1976 |

(Continued)

OTHER PUBLICATIONS

Hadad, D., Geresh, S. and Sivan, A. (2005), Biodegradation of polyethylene by the thermophilic bacterium *Brevibacillus borstelensis*. Journal of Applied Microbiology, 98: 1093-1100.*

*Primary Examiner* — Eric Golightly
*Assistant Examiner* — Arlyn I Rivera-Cordero
(74) *Attorney, Agent, or Firm* — Roylance, Abrams, Berdo & Goodman, L.L.P.

(57) ABSTRACT

The invention relates to a holder for an active ingredient comprising a fixing portion for mechanical fixing under a toilet bowl rim, and a receiving portion joined to the fixing portion for receiving an active ingredient. One problem of such known holders is that they are troublesome to fix to the toilet bowl and to remove again therefrom. This disadvantage is overcome according to the invention by at least parts of the fixing portion being formed from a biodegradable, preferably water-soluble material.

27 Claims, 3 Drawing Sheets

(56) References Cited

U.S. PATENT DOCUMENTS

Figure 1:
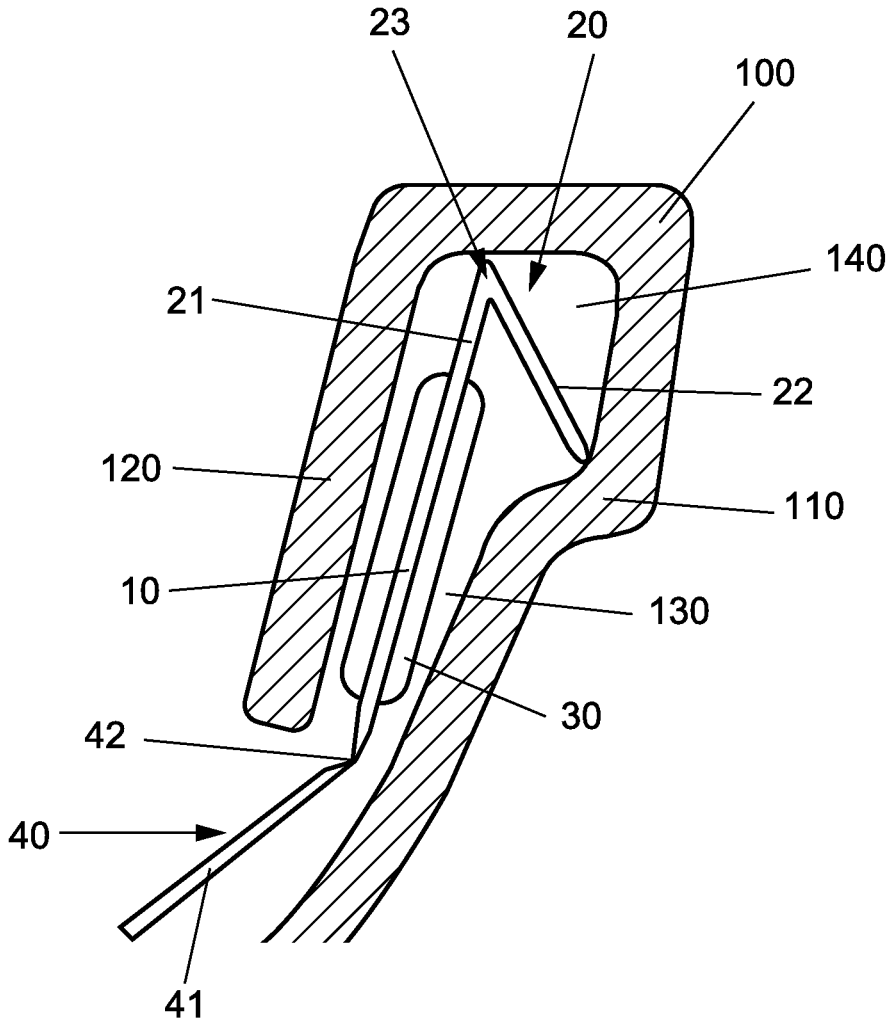

| | | | | |
|---|---|---|---|---|
| 2006/0123529 | A1* | 6/2006 | Conway et al. | 4/231 |
| 2007/0039088 | A1* | 2/2007 | Nguyen et al. | 4/231 |
| 2007/0204389 | A1* | 9/2007 | Graefe et al. | 4/231 |

FOREIGN PATENT DOCUMENTS

| | | | |
|---|---|---|---|
| GB | 813392 | * | 5/1959 |
| GB | 2 394 170 | | 4/2004 |
| GB | 2394170 | * | 4/2004 |

* cited by examiner

INVISIBLE TOILET BOWL DEODORIZER BLOCK

FIELD OF THE INVENTION

The invention relates to a holder for an active ingredient, comprising a fixing portion for mechanical fixing under a toilet bowl rim, and a receiving portion joined to the fixing portion for receiving an active ingredient. Another aspect of the invention is a toilet cleaning device comprising a holder which may be fixed to the toilet rim and an active ingredient for cleaning, disinfecting and/or deodorising a toilet. Finally, the invention also relates to a method for cleaning, disinfecting and/or deodorising a toilet comprising the steps: fixing a fixing portion of a holder under a toilet bowl rim, providing an active ingredient in a receiving portion joined to the fixing portion, dissolving a proportion of the active ingredient with water on each flush, removing the holder once the active ingredient has been consumed and to a method for producing the above-stated toilet cleaning device.

BACKGROUND OF THE INVENTION

Holders and toilet cleaning devices of the above-stated type for carrying out the above-stated method are known. Thanks to being fixed under a toilet bowl rim, they permit a relatively attractive arrangement of the holder in the toilet bowl rim zone and, with regard to their overall visual appearance, are superior to the likewise conventional holders which provide fixing by means of holder portion laid over the rim, as for example disclosed in CH 575 140 A5.

A holder of the initially stated type for fixing under the rim is disclosed, for example, in DE 1 953 658 or in WO 03/095753 A1. While these holders do indeed avoid the clip extending over the toilet rim which is unattractive and problematic with regard to cleaning the toilet, they exhibit the considerable disadvantage that both fitting and removal of these holders require the user to reach into the toilet bowl, which is undesirable for hygiene reasons.

Another disadvantage of these known holders is the fact that, for fitting and removal, a visible and holdable portion of the holder must be provided in order to allow it to be held by hand or with an auxiliary tool when it is being placed under the rim or removed from under the rim.

EP 0 773 330 A1 discloses a tablet dispenser which can be fixed over the rim of a toilet bowl with the assistance of a known, hook-shaped holder arm. The holder embodied in this manner can be detached from the fixing over the toilet bowl rim without reaching into the toilet bowl and, after use, flushed away down the toilet. For this purpose, the holder is formed from a readily compressible film material which is biodegradable.

SUMMARY OF THE INVENTION

The object of the present invention is to provide a more aesthetically attractive holder which may be used with reduced hygiene problems in comparison with known holders.

DETAILED DESCRIPTION OF THE INVENTION

According to the invention, this object is achieved with a holder of the above-stated type by forming at least some parts of the fixing portion from a biodegradable, preferably water-soluble material.

Use of the holder is here not limited to mechanical fixing under a toilet bowl rim, but the holder is likewise suitable for mechanical fixing beneath the edge of a swimming pool, the edge of a whirlpool bath, the rim of a urinal, or the like, thus in any application in which it is desired to fix an active ingredient by means of a holder under the rim or edge of a sanitary installation, pool or the like.

The embodiment according to the invention ensures that at least one part of the fixing portion is biodegradable and, in this manner, the holder is detached from the fixing under the toilet bowl rim. The user is therefore no longer required to touch the holder with his/her hands in order to remove the holder.

The biodegradable part of the fixing portion may in particular here be produced from biodegradable plastic or a plastics blend, for example polyvinyl alcohol, polylactic acid, polyhydroxybutyric acid, polycaprolactone or melt-processable starch (known by the trade name Bioplast). These materials are water-soluble and can therefore be dissolved by the water which passes under the rim when the toilet is flushed or in another manner.

In a first advantageous embodiment, the entire fixing portion is formed from a biodegradable, preferably water-soluble material. This permits a particularly reliable detachment of the fixing portion from the fixing under the rim. This embodiment furthermore ensures maximally extensive decomposition of the holder, at least disintegration of the holder into smaller pieces, such that flushing away of the holder once it has been dissolved away from the fixing is simplified.

It is here furthermore preferred for the entire receiving portion to be formed from a biodegradable, preferably water-soluble material. In this embodiment, substantial parts of the holder are made biodegradable and flushing away of the holder is consequently substantially simplified.

The holder according to the invention may be further developed by the fixing portion being designed for fixing the holder in the cavity of a toilet bowl rim, in particular for interlocking anchoring in the undercut of a toilet bowl rim or for non-interlocking wedging in the cavity of a toilet bowl rim.

There are in principle various options for fixing the holder under the rim. For example, the fixing portion may take the form of an adhesive portion in order to develop an adhesive fixing force. The fixing portion may furthermore take the form of a suction cup in order to achieve fixing by a friction force generated by a vacuum.

Often, however, a toilet bowl rim is of a U-shaped cross-section, such that a cavity which is open at the bottom is formed. In this case, it is particularly advantageous to fix the fixing portion in the cavity of the rim. Provided that the cavity is formed with an appropriate undercut, namely with a geometry which flares out from the opening of the cavity, interlocking anchoring may be achieved here. Such interlocking anchoring may particularly straightforwardly be rendered ineffective by biodegradation of a part of the fixing portion, such that the holder falls out from the cavity zone.

Alternatively or in addition, non-interlocking wedging may be provided in the cavity of a toilet bowl rim, this in particularly being appropriate when the rim does not have an undercut. In this case, two surfaces of the fixing portion which are oriented in approximately opposite directions relative to one another are preferably wedged against the wall portions of the U-shaped cavity, so as to develop a friction force.

In a further advantageous embodiment, the fixing portion comprises a resiliently deformable portion which, on introduction of the fixing portion under the toilet rim, is deformed in such a manner that the fixing portion passes through the narrow cavity portion of a toilet bowl rim cavity and which, once the fixing portion has been pushed through the narrow cavity portion, rebounds at least in part, such that interlocking anchoring is achieved in the wider undercut of the toilet rim cavity. In this manner, particularly simple fixing in the form of a clip is achieved which may be rendered ineffective by biodegradation of a part of the fixing portion and a consequently declining resilient clamping force. This kind of fixing is primarily suitable for interlocking anchoring, but may, however, be used also for non-interlocking wedging. In this latter case, resilient deformation is only required on introduction and rebound is not necessarily required.

In particular, it is preferred for the biodegradable part of the fixing portion and/or of the receiving portion to be designed so as to degrade once the active ingredient has been consumed. In this manner, it is ensured that the holder does not become detached from the fixing until the active ingredient has been consumed. Biodegradation should be taken to mean in this connection that the biodegradable part is structurally modified to such an extent that the mechanical properties are modified such that the properties required for fixing no longer prevail and the holder consequently falls out from under the toilet rim. This means that complete biodegradation of the corresponding part of the fixing portion is not required, but instead only degradation which has proceeded to such an extent that the desired modification of mechanical properties is brought about.

It is furthermore particularly preferred for the biodegradable part to be designed so as to modify the mechanical properties of the fixing portion in such a manner that the holder becomes detached from its fixing under the toilet bowl rim at the earliest when the active ingredient has been consumed. Reference is made in this connection to the preceding advantageous embodiment.

It is furthermore preferred for the receiving portion to take the form of a grid onto which a solid active ingredient, such as for example a toilet block, may be fixed, preferably by the solid active ingredient at least in part enclosing the grid in interlocking manner. This embodiment ensures that the holder has a particularly slender geometry which is in particular suitable for the entire holder being arranged under the toilet rim and is so substantially no longer visible to the user.

In particular, it is preferred for the holding portion and the receiving portion to be dimensioned such that they are not visible under service conditions. This embodiment ensures that none of the parts of the holder can be seen by the user, so achieving a particularly attractive visual appearance of the toilet with the fitted holder.

It is here particularly preferred for the receiving portion to be arranged within the cavity of the toilet bowl rim when in service. This enables a functionally effective and visually concealed arrangement of the receiving portion of the holder according to the invention.

A further development of the holder according to the invention comprises a handle portion joined to the holder for introducing the fixing portion under the toilet bowl rim. This development substantially simplifies fitting of the holder according to the invention by the user only having to hold the handle portion and use it to slide the holder easily under the toilet bowl rim.

It is particularly preferred in this connection for the handle portion to be detachably fixed to the holder, preferably by means of a predetermined breaking point. The handle portion may be fixed to the holder for example in the form of a clip connection, a clamp connection or an interlocking connection and then detached once the holder has been introduced under the toilet bowl rim. In particular, it is preferred for the handle portion to be fixed in a single piece to the holder and for a zone which is preferably close to the holder to be made as a predetermined breaking point, such that, after fitting, the handle portion can be broken off from the holder. This is in particular advantageous when the holder is arranged in invisible manner and in this way a visible handle portion can be avoided in service.

The above-stated two embodiments may be further developed by the handle portion being biodegradable, preferably water-soluble, in particular more rapidly water-soluble than the active ingredient. In this embodiment, it is possible to dispense with detaching the handle portion, the handle portion instead being removed by a biodegradation process. This is in particular advantageous when the biodegradation process takes place within a short period, for example within a few flushes, for example thanks to rapid water solubility of the handle portion, and the handle portion is thus removed.

In a further advantageous development, the holder according to the invention comprises an indicator portion to indicate the presence of the holder under the toilet bowl rim. Especially when the holder is partially or completely concealed, it is advantageous for the user to be able to verify the presence of the holder by a simple visual inspection. This is achieved by the development according to the invention comprising an indicator portion. The indicator portion may here take the form, for example, of a thin, preferably coloured tape which extends a short distance below the rim and is thus visible.

It is particularly preferred in this connection for the indicator portion simultaneously to act as the handle portion. This permits simplified manufacture and compact, economical implementation of the holder according to the invention. In this embodiment, the handle portion naturally cannot be provided as a removable handle portion, but should instead be designed to remain permanently attached to the holder.

The object of the invention is furthermore achieved by a toilet cleaning device of the initially described type in which the holder is embodied according to any one of the preceding claims. In this case too, the cleaning device according to the invention is not limited to use in a toilet, but may also be used in other applications, for example in a swimming pool or the like, as previously described. Various active ingredients or active ingredient compositions in solid, liquid or gel form which achieve the desired action may be considered as the active ingredient for the cleaning device.

One example of a typical solid active ingredient composition is:

| Constituents | Chemical name | Weight percent |
|---|---|---|
| Emuldac AS-25 | ethoxylate (29 EO) of linear alcohol (C16) | 65 |
| Lipoxol 6000 | polyethylene glycol (12 EO) | 14 |
| Marlipal O 13/120 | polyethylene glycol (12 EO) tridecyl ether | 5 |
| Comperlan 100 | N-(2-hydroxyethyl) coconut fatty acid amide | 5 |
| Licowax KLE FL | octacosanoic acid ester with emulsifier | 5 |
| Perfume oil | | 6 |

Examples of typical odoriferous substances in the perfume oil for this application are:

isobornyl acetate, limonene, ylanate, eucalyptol, dihydromyrcenol, amyl salicylate, benzyl acetate, geranyl nitrile, nerol, 2-methylundecanal and phenylethyl alcohol.

It is here particularly advantageous when the active ingredient takes the form of an agent in liquid or gel form and is enclosed by a receiving portion which comprises at least one opening. The receiving portion may in this case take the form of a substantially closed receptacle which allows the active ingredient to be released through small orifices which are preferably arranged in the upper zone.

Alternatively, it is advantageous in many applications for the active ingredient to take the form of a solid agent which at least partially encloses the receiving portion. The receiving portion may here, for example, take the form of a grid or the like.

A further development of the cleaning device according to the invention comprises an indicator portion, as previously described, wherein the indicator portion is designed to indicate the presence of the active ingredient. In this embodiment, the user can conclude from the indicator portion whether any active ingredient still remains or whether it has already been consumed. This embodiment is in particular advantageous when the biodegradation process of the part of the fixing portion does not result in detachment of the fixing of the holder until some time after the active ingredient has been consumed and consequently the desired action of the active ingredient has already been spent for some considerable time when the holder becomes detached. In this case, it is often advantageous, when it becomes evident from the indicator portion that the active ingredient has been consumed, to fit a second toilet cleaning device which then assumes the cleaning action.

In the above-stated embodiment, it is in particular advantageous for the indicator portion to be fixed in the active ingredient and for said fixing to become ineffective on dissolution of the active ingredient. In this manner, the presence of the active ingredient may straightforwardly be indicated. It is particularly advantageous for this purpose if the indicator portion is fixed in an active ingredient zone which is the final portion of active ingredient to dissolve, such that the indicator portion is not prematurely detached.

It is particularly preferred for the holding portion, the receiving portion and the active ingredient to be arranged, when in service, within the cavity of the toilet bowl rim. In this way, an aesthetically unobtrusive arrangement of the toilet cleaning device according to the invention is achieved.

It is here particularly preferred for the holding portion, the receiving portion and the active ingredient to be arranged, when in service, within the cavity of the toilet bowl rim. This embodiment is suitable for rims with a cavity and permits, on the one hand, good functioning of the toilet cleaning device according to the invention and, on the other hand, provides a visually attractive impression.

A further aspect of the invention is a method of the initially stated type, in which the holder becomes detached from the fixing under the rim by a biodegradation process, in particular by an aqueous dissolution process, and is removed by flushing away from the waste water zone of the toilet bowl.

The method according to the invention is in particular suitable for cleaning, disinfecting and/or deodorising sanitary installations in publicly or commercially used areas. Particularly simple and visually unobtrusive hygienic treatment of these sanitary installations is possible with the method according to the invention. In particular, the method according to the invention may here effectively be carried out with a holder or a toilet cleaning device as previously described.

Finally, a further aspect of the invention is a method for producing a holder with an active ingredient comprising the steps: shaping a holding portion and a receiving portion in a single piece from a resiliently deformable and biodegradable, in particular water-soluble, material, heating a solid active ingredient to change its state of matter into a pasty or liquid state, arranging the heated active ingredient around at least one zone of the receiving portion and cooling the active ingredient. The method is in particular suitable for producing a toilet cleaning device as previously described. It is here preferred to manufacture the holding and receiving portion by an injection moulding process and, once the receiving portion has been formed, preferably to encapsulate it with the active ingredient by injection moulding.

Figure 2:
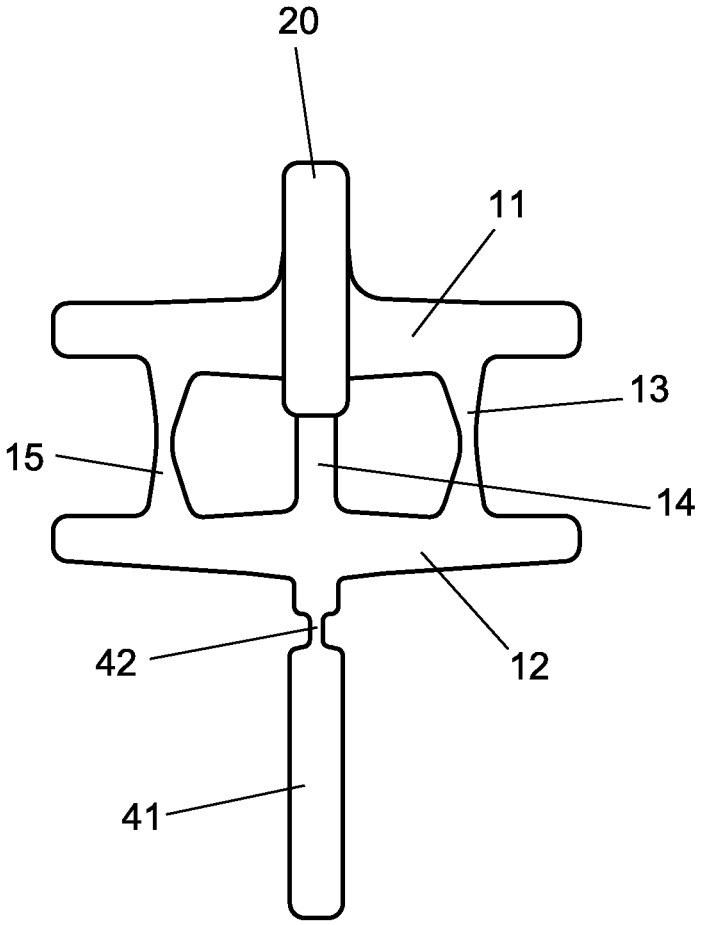
Figure 3:
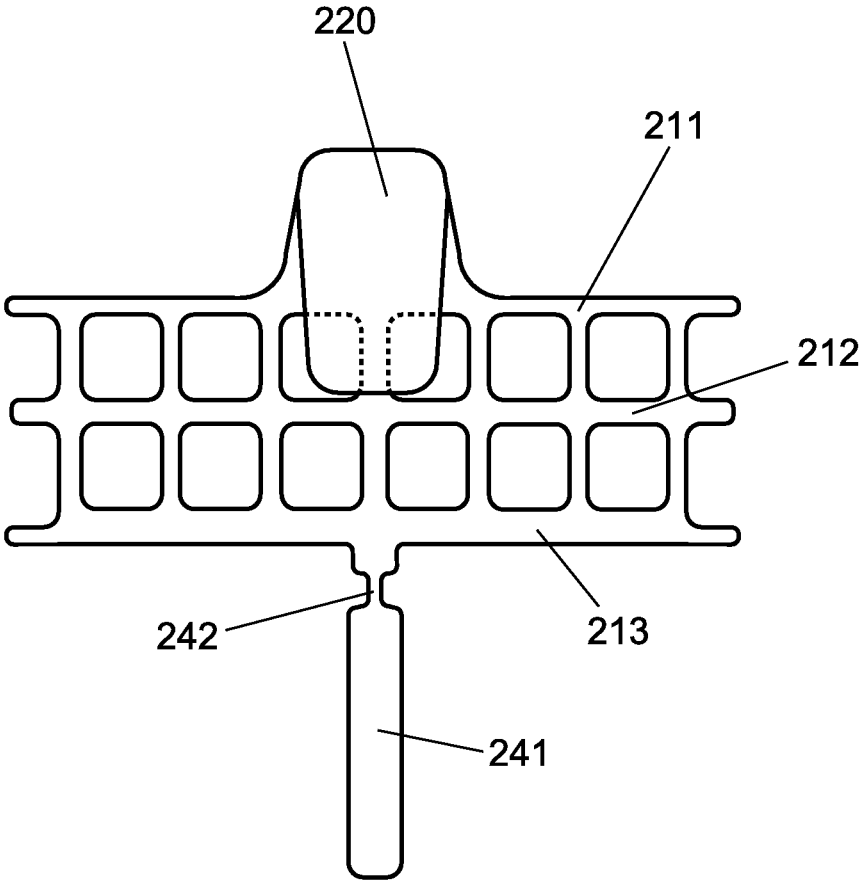

A preferred embodiment is described with reference to Figures, in which:

FIG. 1: is a sectional side view of a holder according to the invention with an active ingredient fixed thereto, inserted under a toilet bowl rim, FIG. 2: is a plan view of the embodiment according to FIG. 1, and FIG. 3: is a plan view of a second embodiment of the holder according to the invention.

FIG. 1 shows the holder according to the invention inserted in the rim 100 of a toilet bowl. The toilet bowl, for example formed from stainless sheet steel or ceramics, is bent inwards into a U shape in the rim zone, so forming a first, external leg portion 110 and a second, internal leg portion 120. In the lower zone of the rim, a narrow cavity portion 130 is formed between the two leg portions 110, 120. This narrow cavity portion 130 flares out at the top to form a wider cavity portion constituting an undercut 140.

The holder according to the invention comprises a receiving portion 10 which, as is clear from FIG. 2, is made up of two approximately mutually parallel horizontal struts 11, 12 and, arranged perpendicular to the horizontal struts, three likewise mutually parallel vertical struts 13-15, which join the two horizontal struts 11, 12 to one another.

The receiving portion 10 is joined on one end to a fixing portion 20, which adjoins the receiving portion 10 in one piece as an extension of the central vertical strut 14. The fixing portion 20 consists of a cross-sectionally approximately V-shaped clasp which is open in the direction of the receiving portion comprising a first leg 21 and a second leg 22.

The first leg 21 and the second leg 22 are per se resiliently deformable and are furthermore joined to one another at a bent resilient zone 23, such that the legs 21, 22 may be moved towards one another and may accordingly pass through the narrow cavity portion 130.

Around the receiving portion 20, there is arranged a solid active ingredient 30 (not shown in FIG. 2), which is fixed interlockingly to the receiving portion 10 between and around the horizontal and vertical struts 11-15. The active ingredient 30 is a toilet block which dissolves slowly on contact with water.

Opposite the fixing portion 20, again as an extension of the central vertical strut 14, a circular portion 40 is shaped in one piece on the holder. The handle portion 40 comprises a handle zone 41 and a predetermined breaking point 42 taking the form of a constriction.

The embodiment of the holder according to the invention shown in FIGS. 1 and 2 is manufactured completely in one piece in an injection moulding process and consists of a plastic which dissolves more slowly than the toilet block 30 fixed to the holder.

The holder according to the invention functions as follows:

The holder with the toilet block 30 formed thereon is held by the user by the handle zone 41 of the handle portion 40 and inserted from below into the narrow cavity portion 130 and pushed upwards. In so doing, the fixing portion 20 is initially deformed by the legs 21, 22 being brought closer together in order to pass through the narrow cavity portion. As soon as the holder has been pushed far enough and the fixing portion reaches the undercut 140, the legs 21, 22 rebound resiliently, so spreading apart and the leg 22 coming to rest against the external wall 110 of the bowl rim. Interlocking anchoring is achieved in this manner.

Thereafter, the user can break the predetermined breaking point 42 by repeatedly flexing or twisting the handle zone relative to the remainder of the holder and remove the handle portion. Since the handle portion consists of biodegradable material, there are no concerns regarding disposal by flushing down the toilet.

After this, the toilet block and the remaining part of the holder are invisibly anchored under the toilet bowl rim. The toilet block 30 release a small quantity of active ingredient on each flush. At the same time, each flush brings about a slower dissolution of the holder, in particular of the fixing portion 20, which, when the toilet block 30 has been consumed, results in structural weakening such that the holder falls out from the anchoring under the rim and may in turn be disposed of without any concerns by being flushed down the toilet. Accordingly, once the toilet block has been introduced, no further intervention is required from the user in order to remove the holder.

FIG. 3 shows a second embodiment of the holder according to the invention which comprises a wider fixing portion 220 than the holder shown in FIG. 2. The holder according to FIG. 3 furthermore differs from that in FIG. 2 by the receiving portion of the holder according to FIG. 3 consisting of three horizontal struts 211-213 which are joined to one another by a plurality of vertical struts. In this way, a finer mesh is provided for receiving the toilet block 30 and a toilet block made from a structurally weaker material may consequently also be received on or fixed to the receiving portion of the embodiment according to FIG. 3.

In addition to the embodiments shown in the Figures, many different designs, both of the fixing portion and of the receiving portion, are conceivable. In particular, the receiving portion may take the form of still finer or coarser meshes. Other three-dimensional structures are furthermore conceivable, such as for example flat baskets, receiving receptacles or the like for storing active ingredients in liquid or gel form.

The toilet block fixed to the holder according to the invention may consist of various materials. In particular, it is preferred for the toilet block to consist of a thermoplastic composition, which may be converted by heating into a pasty or liquid state of matter, may be arranged in this state of matter around the receiving portion and then converted by cooling into a solid state of matter, in which the toilet block is then firmly anchored to the receiving portion.

The invention claimed is:

1. A holder for an active ingredient comprising a fixing portion (20) for mechanical fixing under a rim (100) of a toilet bowl, and a receiving portion (10) joined to said fixing portion for receiving an active ingredient (30), wherein the entire fixing portion is formed from a biodegradable water soluble material, wherein said fixing portion has a rate of dissolving less than a rate of dissolving of said active ingredient, whereby said fixing portion dissolves over a predetermined period of time to release said holder from said toilet bowl after the active ingredient is consumed.

2. A holder according to claim 1, wherein said receiving portion takes the form of a grid (11-15; 211-213) on which a solid active ingredient may be fixed.

3. The holder of claim 1, wherein said receiving portion is made from a biodegradable water soluble material.

4. A holder according to claim 1, wherein said fixing portion is designed for fixing said holder in a cavity (130, 140) of a toilet bowl rim for interlocking anchoring in an undercut (140) of a toilet bowl rim or for non-interlocking wedging in a cavity (130, 140) of a toilet bowl rim.

5. A holder according to claim 4, wherein said fixing portion comprises a resiliently deformable portion (23) which, on introduction of said fixing portion under said toilet rim, is deformed in such a manner that said fixing portion passes through said narrow cavity portion of a toilet bowl rim cavity and which, once the fixing portion has been pushed through the narrow cavity portion, rebounds at least in part, such that interlocking anchoring is achieved in the wider undercut of the toilet rim cavity.

6. A holder according to claim 1, wherein said fixing portion and the receiving portion are dimensioned such that they are not visible under service conditions.

7. A holder according to claim 6, wherein, when in service, said receiving portion is arranged within a cavity of the toilet bowl rim.

8. A holder according to claim 1, wherein an indicator portion for indicating the presence of the holder under the toilet bowl rim.

9. A holder according to claim 8, wherein said indicator portion simultaneously acts as a handle portion.

10. A holder according to claim 1, wherein the entire receiving portion is formed from a biodegradable water soluble material.

11. A holder according to claim 10, wherein said biodegradable material of said fixing portion and/or of said receiving portion is designed so as to degrade once the active ingredient has been consumed.

12. A holder according to claim 10, wherein said biodegradable material is designed so as to modify mechanical properties of said fixing portion in such a manner that said holder becomes detached from its fixing under the toilet bowl rim when the active ingredient has been consumed.

13. A holder according to claim 1, wherein a handle portion (40) joined to said holder for introducing said fixing portion under the toilet bowl rim.

14. A holder according to claim 13, wherein said handle portion is detachably fixed to said holder.

15. The holder of claim 14, wherein said handle portion is detachably coupled to said holder by a breakable point.

16. A holder according to claim 13, wherein said handle portion is biodegradable.

17. The holder of claim 16, wherein said handle portion is made from a biodegradable water soluble material having a dissolving rate slower than the active ingredient.

18. A toilet cleaning device comprising:

a holder (10, 20) which may be fixed to a toilet rim, an active ingredient (30) for cleaning, disinfecting and/or deodorising a toilet, wherein said holder comprises a fixing portion (20) for mechanical fixing under a rim (100) of a toilet bowl, and a receiving portion (10) joined to said fixing portion for receiving an active ingredient (30), wherein the entire fixing portion is formed from a biodegradable water soluble material, wherein said fixing portion has a rate of dissolving less than a rate of dissolving of said active ingredient, whereby said fixing portion dissolves over a predetermined period of time to release said holder from said toilet bowl after the active ingredient is consumed.

19. A toilet cleaning device according to claim 18, wherein said active ingredient takes the form of an agent in liquid or gel form and is enclosed by a receiving portion which comprises at least one opening.

20. A toilet cleaning device according to claim 18, wherein said active ingredient takes the form of a solid agent which at least partially encloses the receiving portion.

21. A toilet cleaning device according to claim 18, wherein an indicator portion which is designed to indicate the presence of the active ingredient.

22. A toilet cleaning device according to claim 21, wherein said indicator portion is fixed in the active ingredient and said fixing becomes ineffective on dissolution of the active ingredient.

23. A toilet cleaning device according to claim 19, wherein said holder, the receiving portion and the active ingredient are dimensioned such that they are not visible under service conditions.

24. A toilet cleaning device according to claim 23, wherein said holder, the receiving portion and the active ingredient are arranged, when in service, within a cavity of the toilet bowl rim.

25. A method for cleaning, disinfecting and/or deodorizing a toilet comprising the steps of:

fixing a fixing portion of a holder under a toilet bowl rim, said fixing portion being made from a biodegradable water soluble material, providing an active ingredient in or on a receiving portion joined to the fixing portion, dissolving a proportion of the active ingredient with water on each flush, removing the holder once the active ingredient has been consumed, wherein said holder becomes detached from the fixing under the rim by dissolving said fixing portion by flushing the toilet and is removed by flushing away from the waste water zone of the toilet bowl, wherein said fixing portion has a rate of dissolving less than a rate of dissolving of said active ingredient, whereby said fixing portion dissolves over a predetermined period of time to release said holder from said toilet bowl after the active ingredient is consumed.

26. The method of claim 25, wherein said holder is made from a biodegradable water soluble material and where said method detaches the holder from the fixing portion by dissolving the biodegradable water soluble material.

27. A method for producing a holder for an active ingredient comprising:

a) shaping a holding portion to be adapted for mechanical fixing under the rim (100) of a toilet bowl and a receiving portion in a single piece from a resiliently deformable and biodegradable water soluble material, b) heating a solid active ingredient to change its state of matter into a pasty or liquid state, c) arranging the heated active ingredient around at least one zone of the receiving portion and d) cooling the active ingredient.

* * * * *